United States Patent [19]

Muranaka et al.

[11] Patent Number: 4,825,822

[45] Date of Patent: May 2, 1989

[54] ROCKER ARM ARRANGEMENT FOR MULTI-VALVE INTERNAL COMBUSTION ENGINE

[75] Inventors: Shigeo Muranaka, Yokosuka; Shigeru Kamegaya, Tokyo; Tooru Yoshimura; Yutaka Matayoshi, both of Yokosuka, all of Japan

[73] Assignee: Nissan Motor Co., Ltd., Japan

[21] Appl. No.: 900,844

[22] Filed: Aug. 27, 1986

[30] Foreign Application Priority Data

| | | | |
|---|---|---|---|
| Aug. 29, 1985 | [JP] | Japan | 60-130798[U] |
| Oct. 22, 1985 | [JP] | Japan | 60-160701[U] |
| Oct. 23, 1985 | [JP] | Japan | 60-161266[U] |
| Feb. 12, 1986 | [JP] | Japan | 61-17460[U] |

[51] Int. Cl.[4] ..... F01L 1/18

[52] U.S. Cl. ..... 123/90.44; 123/90.42; 123/90.4

[58] Field of Search ..... 123/90.27, 90.44, 90.41, 123/90.4, 90.43, 90.22, 90.42

[56] References Cited

U.S. PATENT DOCUMENTS

| | | | |
|---|---|---|---|
| 2,322,173 | 6/1943 | Spencer | 123/90.41 |
| 2,610,617 | 9/1952 | Pielstick | 123/90.4 |
| 3,139,870 | 7/1964 | Sampietro | 123/90.4 |
| 3,672,338 | 6/1972 | Yamanouchi | 123/90.27 |
| 4,338,894 | 7/1982 | Kodama | 123/90.43 |
| 4,436,062 | 3/1984 | Nakakobara et al. | 123/90.27 |
| 4,438,736 | 3/1984 | Hara et al. | 123/90.27 |
| 4,438,739 | 5/1984 | Arai et al. | 123/90.43 |
| 4,506,635 | 3/1985 | Van Rinsum | 123/90.4 |
| 4,530,318 | 7/1985 | Semple | 123/90.27 |
| 4,546,734 | 10/1985 | Kodama | 123/90.43 |
| 4,561,391 | 12/1985 | Simko | 123/90.27 |
| 4,614,171 | 9/1986 | Malhotra | 123/90.44 |
| 4,628,874 | 12/1986 | Barlow | 123/90.44 |
| 4,649,874 | 3/1987 | Sonoda et al. | 123/90.44 |
| 4,709,667 | 12/1987 | Ichihara et al. | 123/90.27 |

FOREIGN PATENT DOCUMENTS

| | | |
|---|---|---|
| 59-103907 | 6/1984 | Japan . |
| 0568768 | 4/1945 | United Kingdom . |
| 1192099 | 5/1970 | United Kingdom . |
| 1331226 | 9/1973 | United Kingdom . |
| 1437285 | 5/1976 | United Kingdom . |

OTHER PUBLICATIONS

Motor Fan, Mar. 1985, pp. 170, 171, & index page.
Internal Combustion Engine, Oct. 1985, pp. 22–29 and index pp. 120 & 121.

*Primary Examiner*—Willis R. Wolfe, Jr.
*Assistant Examiner*—M. Macy
*Attorney, Agent, or Firm*—Leydig, Voit & Mayer

[57] ABSTRACT

In order to reduce the mass of a rocker arm and simultaneously simplify the adjustment of the valve clearances the rocker arm is pivotally mounted on a universal joint so that it may tilt and establish a three point contact between the universal joint and the tops of the two valve stems. By incorporating a hydraulic lifter in the universal joint arrangement constant lash free automatic zero clearance adjustment is rendered possible. Utilizing a roller as a cam follower permits a reduction in valve train friction loss. To prevent the rocker arm from meandering retaining flanges are provided on the rocker arm which envelope the tops of the valve stems.

23 Claims, 8 Drawing Sheets

ROCKER ARM ARRANGEMENT FOR MULTI-VALVE INTERNAL COMBUSTION ENGINE

BACKGROUND OF THE INVENTION

1. Field of the Invention

The present invention relates generally to a multi-valve internal combustion engine and more specifically to a valve train arrangement for an internal combustion engine which is arranged to lift two (inlet or exhaust) valves simultaneously.

2. Description of the Prior Art

In a previously proposed arrangement disclosed in Japanese publication "MOTOR FAN" issued on Mar. 1, 1985 by "Saneishobou" Co. Ltd., each cylinder of a twin overhead cam engaine is equipped with two inlet vvalves 1 and two exhaust valves 2. Each pair of valves is arranged to be simultaneously lifted by a single rocker arm 3 which is driven by a single cam.

This arrangement, while reducing the number of major moving parts required to operate the four valves, encounters the drawback that each of the rocker arms 3 is provided with two clearance adjusting screws 4 and associated lock nuts (not illustrated). These clearance adjusting screws 4 and nuts increase the mass of the rocker arms 3. Accordingly, in order to enable high RPM operation, it is necessary to increase the spring constant of the valve springs 5 to ensure that the movement of the valves 1, 2 follows the movement of the cams 6, 7. This increases the friction loss of the valve train and increases the fuel consumption of the engine.

Further, as there is one clearance adjust screw 4 for each valve the number of parts is increased and engine maintenance rendered troublesome as each valve must be individually adjusted.

SUMMARY OF THE INVENTION

It is an object of the present invention to provide a rocker arm arrangement which enables the simultaneous lift of two valves with a single arm, which reduces the mass of the arm and which simultaneously permits the automatic adjustment of the clearances between the valve stems and the rocker arm.

In brief, in order to achieve the above object, the rocker arm of the present invention is pivotally mounted on a "univeral joint" so that it may tilt and establish a three point contact between the universal joint and the tops of the two valve stems. By incorporating a resilient support in the form of a hydraulic lifter in the universal joint arrangement, lash free constant automatic zero clearance adjustment is rendered possible. Utilizing a roller as a cam follower permits a reduction in valve train friction loss. To prevent the rocker arm from meandering, retaining flanges are provided on the rocker arm which extend down around the tops of the valve stems.

More specifically, the present invention takes the form of an internal combustion engine which includes a combustion chamber; a manifold; first and second valves controlling fluid communication between the manifold and the combustion chamber; a cam connected to a source of rotational energy; a rocker arm; a support disposed on the engine; a convex portion on one of the support and the rocker arm; a concavity formed in the other of the support and the rocker arm, the concavity being arranged to receive the convex portion in a manner to define a universal joint via which the rocker arm is pivotally supported on the engine; a cam follower on the rocker arm; and first and second contact portions which operatively engage the first and second valves respectively.

DETAILED DESCRIPTION OF THE PREFERRED EMBODIMENTS

Figure 1:
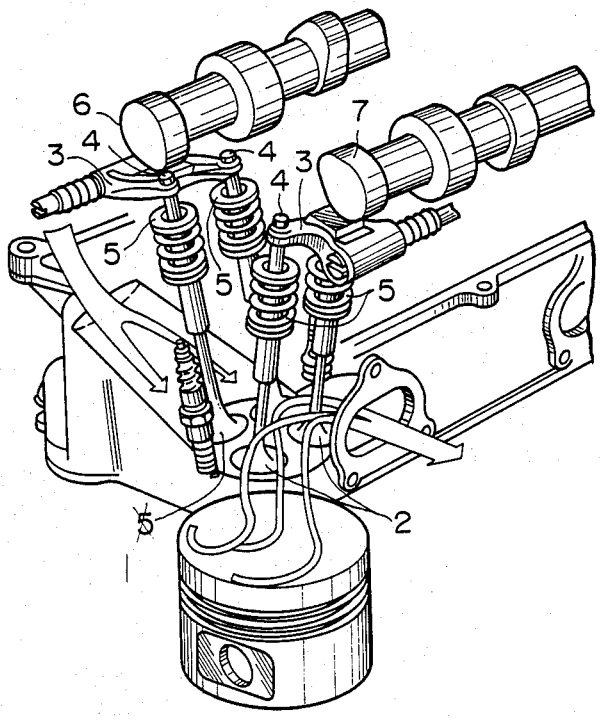
FIG. 1 (PRIOR ART)
FIG. 1 is a perspective view of the prior art arrangement discussed briefly in opening paragraphs of the instant disclosure.
Figure 2:
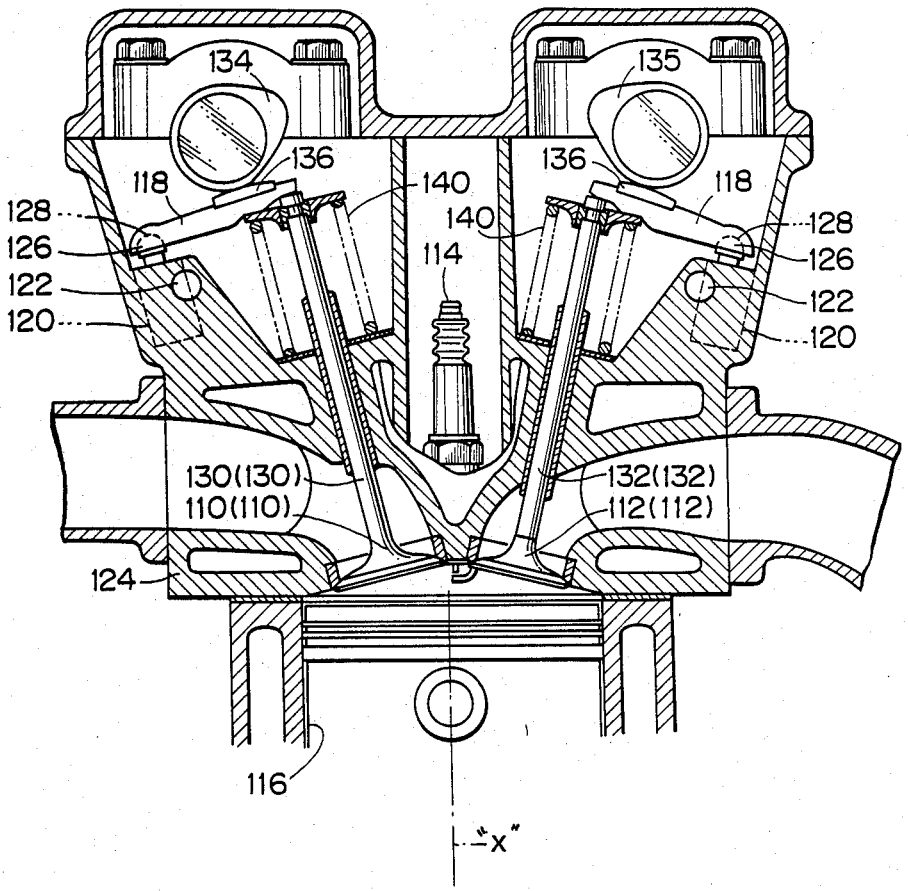
FIG. 2 is a sectional elevation of an engine equipped with a first embodiment of the present invention.
Figure 3:
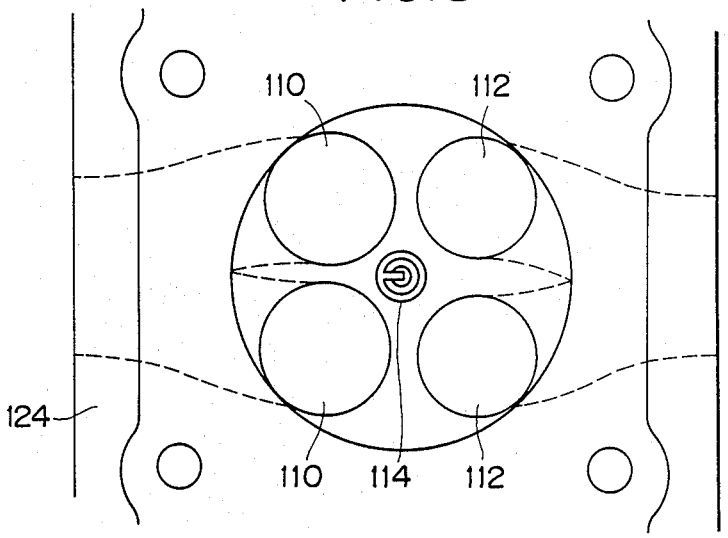
FIG. 3 is a plan view showing the location of the spark plug and inlet and exhaust ports in the arrangement shown in FIG. 1.
Figure 4:
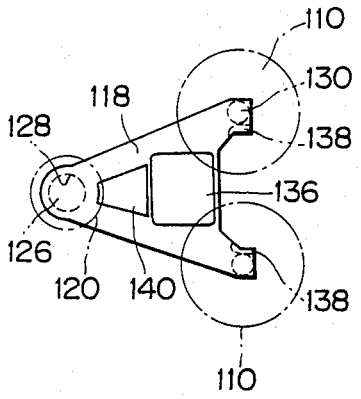
FIG. 4 is a plan view of a rocker arm according to a first embodiment of the present invention.

FIGS. 2 to 7 show a first embodiment of the present invention. In this arrangement the engine to which the present invention is applied is equipped with two inlet valves 110 and two exhaust valves 112 (see FIG. 3). In this engine each combustion chamber is provided with a single spark plug 114 which is located so as to be essentially aligned with the axis "X" of the cylinder bore 116.

Each pair of inlet and exhaust valves 110, 112 are arranged to be operated by bifurcated rocker arms 118 having an essentially triangular or "A" shape.

In the first embodiment, the outboard ends of the rocker arms 118 are pivotally supported on hydraulic valve lifter units 120. These units are supplied with hydraulic fluid under pressure via elongate bores 122 formed in the cylinder head 124 of the engine. In this instance each of the hydraulic lifter units 120 is provided with a spherically convex or domed end 126 which is received in a corresponding spherically concave recess 128 formed in each rocker arm 118. This arrangement defines a kind odf "universal joint" which pivotally supports the arm in a manner which allows the same to pivot through a limited angle in all directions and in particular in a first plane which intersects the cylinder bore axis "X" and a second plane which is normal to the first one and which also intersects the bore axis. It is of course possible to reverse the situation and provide the domed portion on the rocker arm and the spherical concavity in the top of the hydraulic lifter if desired. However, the illustrated arrangement is generally easier to manufacture.

Figure 5:
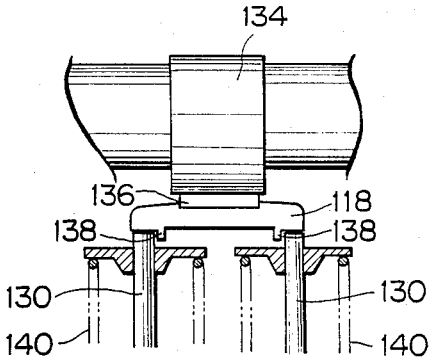
FIG. 5 is a side elevation of the arrangement shown in FIG. 4.
Figure 6:
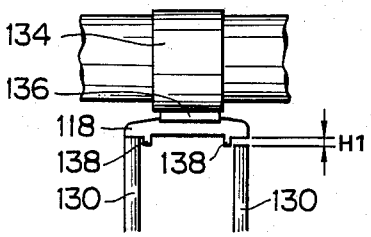
FIGS. 6 and 7 are elevations which show the automatic clearance adjustment which is possible with the present invention.
Figure 7:
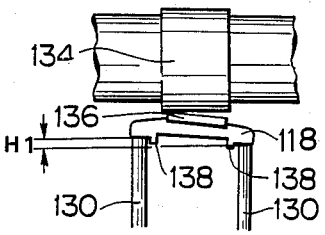

With the above arrangement, in the event that a slight difference in the length, for example H1 such as shown in FIG. 6, (note that H1 is exaggerated for the sake of illustration) of the valve stems 130, 130 & 132, 132 or the like occurs (for example the variation which tends to occur in mass production), while the cam followers 136 engage the base circles of cams 134 and the moment produced by the force of the hydraulic lifters 120 is greater than the moment required to incline the rocker arms under their own weight, then the clearances H1 are maintained in the manner illustrated in FIG. 6. However, when the cam lobes begin to engage the cam followers the respective rocker arms pivot or rotate in a manner to assume positions such as shown in FIG. 7. Subsequently, the valves on the left hand side (as seen in the drawings) begin to undergo a slight amount of lift and the rocker arms rotate in the reverse direction until such time as they assume an essentially horizontal orientation (with respect to the axis of the cam shaft) such as shown in FIG. 5. Following this the valves on the right hand side of the drawings begin to be lifted.

It will be noted that even when an abnormally large gap tends to occur the amount of rotation of the associated rocker arm 118 is only about 0.3 degrees. Accordingly, it is possible to machine the cams and the associated cam followers in a manner to have flat surfaces without any particular detrimental effect. Alternatively, it is possible to form the surface of either the cams or the cam followers to have spherical convex surfaces so as to allow the cam followers to "roll" on the surfaces of the cams.

In the first embodiment the cam follower takes the form of a plate-like member 136 fixed to/or formed on the upper surface of each rocker arm.

To reduce the weight of each arm suitable apertures (e.g. 140) and/or cut-outs are formed.

In the first embodiment the use of the hydraulic lifters 120 in combination with the "rolling" or "tilting" action of the rocker arms, enables a zero clearance to be automatically maintained between the tops of the valve stems and the rocker arms 118 without lash at all times.

It is also within the scope of the present invention to replace the hydraulic lifters 120 with manually adjustable fixed supports. This also applies to embodiments described hereinafter.

It will be noted that the rocker arms 118 of the first and subsequent embodiments are symmetrically configured with respect to an imaginary line which passes through the site at which the arm is pivotally supported and the site at which the cam follower is located. This tends to unify the forces applied to each of the valves and thus tends to minimize abrasion and the like between various contacting surfaces.

In the first embodiment each rocker arm 118 is provided with flanges 138 which in this instance depend down on the inboard sides of the valve stems. These flanges 138 limit the amount of lateral movement which is possible between the rocker arms 118 and the valve stems 130, 132 and tends to obviate any possible separation which might occur therebetween. Viz., as the rocker arms of the present invention are "universally" pivoted it is necessary to add structure which will maintain the arms in the desired location over the tops of the valve stems.

With the arrangement disclosed hereinabove, the mass of each rocker arm is reduced as compared with the FIG. 1 prior art device in that the heavy screw adjustment arrangements are omitted. This reduction in mass permits the use of valve springs 140 which have a spring constant lower than that required with the FIG. 1 arrangement. This permits a reduction in the friction losses encountered by the valve train and thus promotes an increase in fuel economy.

Figure 8:
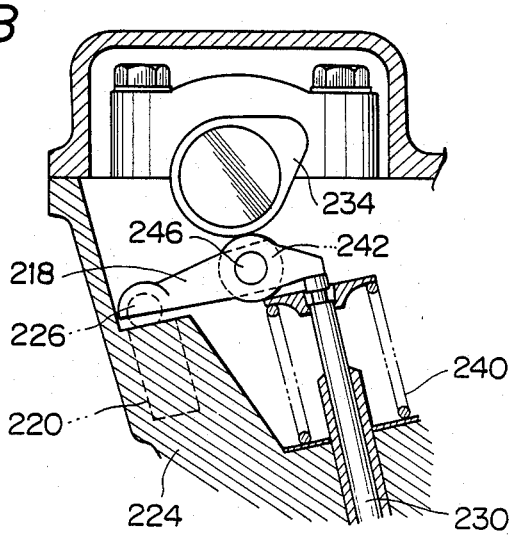
FIG. 8 is a side sectional elevation of a second embodiment of the present invention.
Figure 9:
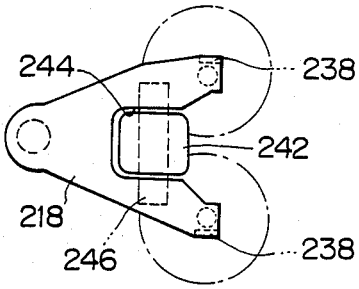
FIGS. 9 and **9*a* are plan views of the rocker arm arrangement shown in 8**.
Figure 10:
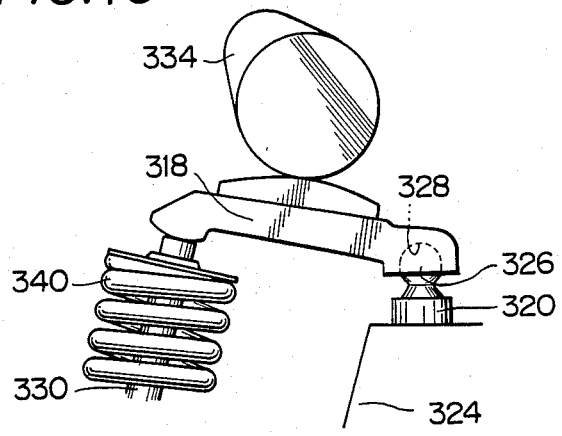
FIGS. 10 to 13 show a third embodiment of the present invention.
Figure 11:
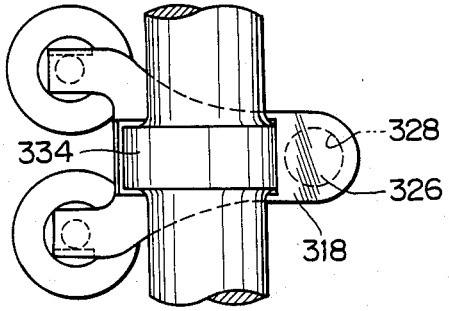

FIGS. 8 and 9 show a second embodiment of the present invention. In this embodiment the cam follower 136 of the first embodiment is replaced with a roller arrangement. As in the case of the first embodiment it is possible to form either the cam 234 or the roller 242 with a spherically convex surface so as to facilitate the above mentioned "tilting" or "rolling". Alternatively, it is possible to form both the roller or the cam with flat surfaces.

In order to mount the roller 242 in position the rocker arms are formed with recesses 244 which give the arms a kind of "Y" configuration. The ends of the arms of the rocker arm 218 are equipped with downward-projecting flanges 238 which adjoin the outboard sides of valve stems 230 and limit the amount of lateral movement which is possible between the rocker arm 218 and the valve stems 230.

In this embodiment each roller is rotatably mounted on a shaft 246 which is force fitted or similarly secured through holes formed in the "arms" of the associated Y-shaped rocker arm.

The provision of the rollers 242 reduces the amount of friction between the cams 234 and the arms 218 and thus reduces the friction loss of the valve train and promotes improved fuel economy.

Figure 12:
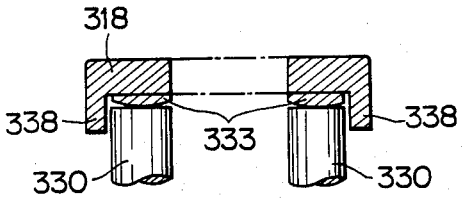
Figure 13:
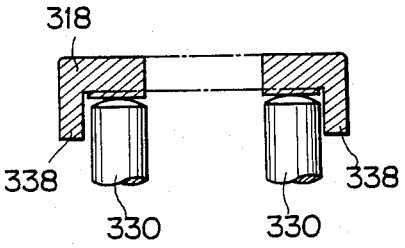

FIGS. 10 to 13 show a third embodiment of the present invention. In this arrangement the sections of the rocker arms 318 which contact the tops of the valve stems 330, 332 are formed with spherically convex surfaces 333 (see FIGS. 10 and 12). With this arrangement when any tilting of a rocker arm 318 occurs due to a slight difference in valve stem length or the like, the force applied to the tops of the valve stems is caused to act directly along the axes thereof and not at an angle which will tend to bias the valves sideways in a manner which will increase the friction with the associated valve guides and/or (in the worst case) bend the same. It is of course also possible to reverse the situation and dome the tops of the valve stems and provide flat surfaces on the contact sections of the rocker arms such as shown in FIG. 13.

In this embodiment the retaining flanges 338 which prevent the rocker arms 318 from meandering away from the tops of the valve stems are formed on the outboard side of the arms.

Figure 14:
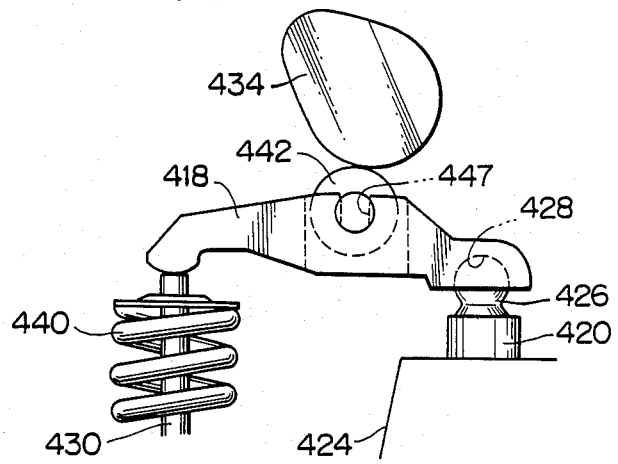
FIGS. 14 to 16 show a fourth embodiment of the present invention.
Figure 15:
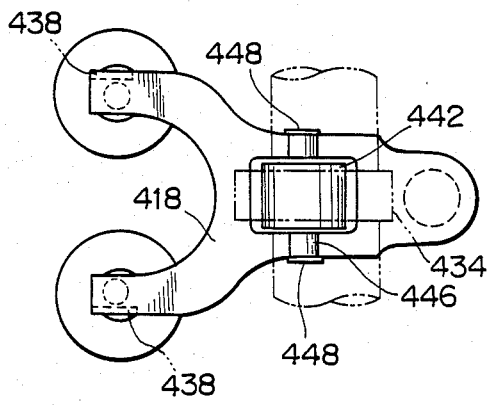
Figure 16:
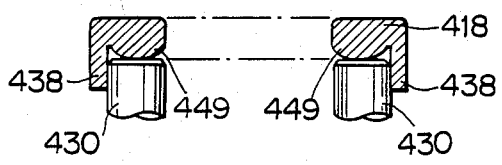
Figure 17:
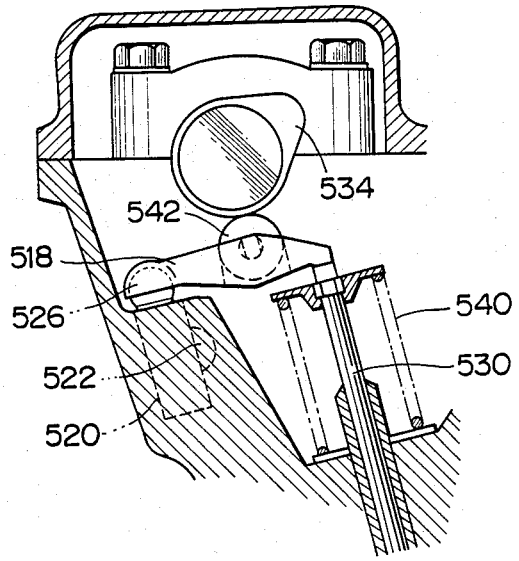
FIGS. 17–21 and 22–23 show fifth and sixth embodiments respectively.

FIGS. 14 to 16 show a fourth embodiment of the present invention. In this arrangement rollers 442 are mounted on shafts 446 and the shafts 446 received in slots 447 formed in the rocker arms 418. The shafts 446 are formed with radially outwardly extending flanges 448 at each end and with opposed flat surfaces just inboard of the flanges 448. The flat surfaces are arranged to be spaced by essentially the width of the slots 447 and to be snugly received in a rattle free manner therein.

This arrangement facilitates assembly and/or replacement of components.

The contact surfaces of each of the rocker arms 418 which engage the tops of the valve stems are formed with spherically convex surfaces 449 in a manner similar to the previous embodiment (FIG. 12). The retaining flanges 438 in this embodiment are arranged on the outboard sides of the valve stems 430.

In this embodiment either roller 442 or the associated cam may be formed with a slightly spherical convex surface to facilitate "rolling" of the rocker arms.

FIGS. 17 to 21 show a fifth embodiment of the present invention. In this arrangement both the rollers 542 and the cams 543 are formed with flat surfaces and shafts 546, on which the rollers 542 are mounted, are arranged to be adjustable with respect to the arms 518. The tops of the valve stems 530 and the contact surfaces on the rocker arms 518 which engage the stem tops are also formed so as to have flat surfaces.

Figure 21:
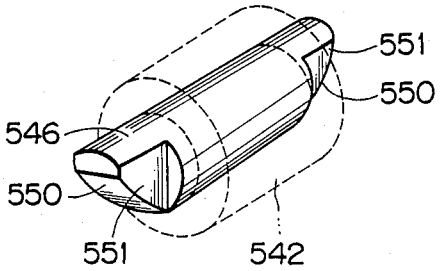

As best seen in FIG. 21 the ends of the shafts 546 on which the rollers 542 are supported are formed with curved surfaces 550 and opposed flat surfaces 551. The rocker arms 518 are formed with slots having corresponding curved bottoms and in which the ends of the roller shafts 546 are received. The curvature of the surfaces is selected to have a radius R and constitute part of a common circle A shown in FIG 19.

With this arrangement in the event that any difference in valve stem length of the like causes an uneven clearance between the tops of the valve stems (e.g. H2 shown in FIG. 20) the shaft 546 tends to slide in the curved grooves in which is it received and change its atlitude or orientation with respect to the rocker arm 518. This brings the flat surfaces of roller and the cam into appropriate engagement.

Figure 18:
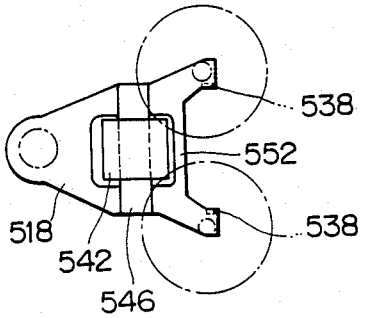
Figure 19:
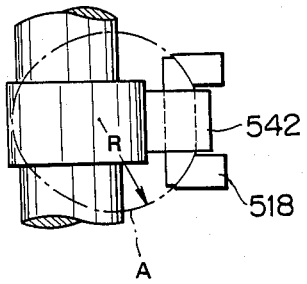
Figure 20:
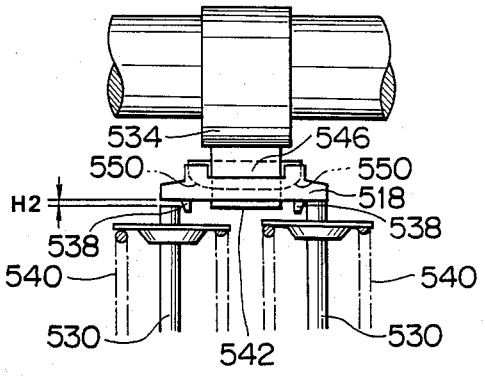

As shown in FIG. 18 the apertures in which the rollers are disposed are closed by a web section 552. This section adds structural rigidity to the arms and minimizes the possibility of flexture of the finger-like sections thereof causing a slight change in valve lift timing.

Figure 22:
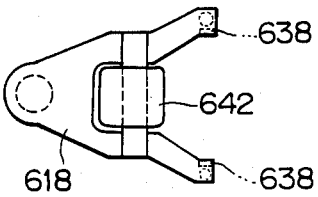
Figure 23:
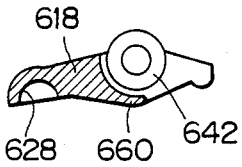

FIGS. 22 and 23 show a sixth embodiment of the present invention. This arrangement is essentially similar to the fifth one and differs in that the web sections 552 are omitted. This opens the apertures in which the rollers 642 are disposed and faciliates the machining of these sites. To compensate for the removal of the transverse web, webs 660 which extend along each arm of the "Y" shaped rocker arm and under the roller 642 as shown in FIG. 24 are provided.

What is claimed is:

1. An internal combustion engine comprising:
means defining a combustion chamber;
a manifold;
first and second valves controlling fluid communication between said manifold and said combustion chamber;
a cam connected to a source of rotational energy;
a rocker arm;
a support disposed on said engine;
a cam follower which is mounted on said rocker arm and which engages with said cam; and
first and second contact portions which are mounted on said rocker arm and which operatively engage said first and second valves, respectively,
one of said support and said rocker arm having a convex portion formed thereon, and the other of said support and said rocker arm having a concavity formed therein which is arranged to receive said convex portion in a manner so as to define a universal joint by means of which said rocker arm is pivotally supported by said support.

2. An internal combustion engine as claimed in claim 1, further comprising:
flanges which extend from said rocker arm proximate the portions of said first and second valves which are engaged by said contact portions for maintaining a predetermined relationship between said contact portions and said first and second valves.

3. An internal combustion engine as claimed in claim 1, wherein said support includes a hydraulic lifter which resiliently supports said universal joint.

4. An internal combustion engine as claimed in claim 1, wherein said support is immovably mounted on said engine.

5. An internal combustion engine as claimed in claim 1, further comprising first means defining a convex spherical surface one one of said cam and said cam follower which permits said cam follower to roll by a limited amount on said cam.

6. An internal combustion engine as claimed in claim 1, further comprising second means defining a convex spherical surface on one of said contact portions and the portions of said first and second valves which engage said contact portions.

7. An internal combustion engine as claimed in claim 1, wherein said cam follower takes the form of a roller rotatably mounted on said rocker arm.

8. An internal combustion engine as claimed in claim 7, wherein said roller is mounted on a shaft, said shaft being adjustably mounted on said rocker arm in a manner to permit said roller to remain in a desired surface-to-surface contact with said cam.

9. An internal combustion engine as claimed in claim 1, wherein said rocker arm is formed with a web which increases the structural rigidity of the rockeer arm.

10. An internal combustion engine comprising:
means defining a combustion chamber;
a first manifold;
a second manifold;
first and second valves controlling fluid communication between said first manifold and said combustion chamber;
third and fourth valves controlling fluid communication between said second manifold and said combustion chamber;
a first cam shaft having a first cam disposed thereon;
a first universal joint resiliently supported on said engine;
a first rocker arm having a first end pivotally coupled with said first universal joint and having a second end engaging said first and second valves;
a first roller rotatably supported on said first rocker arm and operatively engaged with said first cam;
a second cam shaft having a second cam disposed thereon;
a second universal joint resiliently supported on said engine;
a second rocker arm having a first end pivotally coupled with said second universal joint and having a second end engaging said third and fourth valves; and
a second roller rotatably supported on said second rocker arm and operatively engaged with said second cam.

11. An internal combustion engine as claimed in claim 10 wherein said first and second rollers engage said first and second cams, respectively, in line contact.

12. An internal combustion engine having a combustion chamber, a manifold, first and second valves controlling fluid communication between the manifold and the combustion chamber, a cam connected to a source of rotational energy, and a rocker arm arrangement comprising:

a bifurcated rocker arm having first and second ends, said second end having first and second contact portions operatively engaging the first and second valves, a support disposed on said engine, a convex portion on one of said support and said first end of said rocker arm, a concavity formed in the other of said support and said first end of said rocker arm, said concavity receiving said convex portion and defining a universal joint allowing said rocker arm to pivot in all directions and said first and second contact portions to be maintained in operative engagement with said first and second valves, and a cam follower on said rocker arm and operatively engaged by said cam.

13. An internal combustion engine comprising:

means for defining a combustion chamber;

first and second poppet valves which control fluid communication between said combustion chamber and a manifold of the engine, each of said poppet valves having a valve stem;

a resilient support which is mounted on a portion of said means for defining a combustion chamber;

a Y-shaped rocker arm having a leg and first and second arms which extend from said leg, said leg portion having an outer end which together with said resilient support defines a universal joint, each of said first and second arms having an outer end which contacts the top of the valve stem of one of said first and second poppet valves; and a roller which is rotatably supported by said rocker arm between said first and second arms and which is disposed between said resilient support and said poppet valves and which is arranged so as to engage with a cam which is disposed on a cam shaft of the engine.

14. An internal combustion engine as claimed in claim 13 wherein said first and second arms of said rocker arm have first and second flanges which are formed on said outer ends thereof and which can engage with the tops of said valve stems of said poppet valves.

15. An internal combustion engine as claimed in claim 13 further comprising a shaft which supports said roller, said arms of said rocker arm having bores formed therein in which the ends of said shaft are received.

16. An internal combustion engine as claimed in claim 13 wherein said roller has a domed surface, whereby the rolling of the rocker arm in a plane in which the axis of rotation of said roller lies is facilitated.

17. An internal combustion engine comprising:

means for defining a combustion chamber;

first and second inlet valves which control fluid communication between said combustion chamber and an intake manifold of the engine, each of said inlet valves having a valve stem;

a first resilient support which is mounted on a portion of said means for defining a combustion chamber;

a first Y-shaped rocker arm having a leg and first and second arms which extend from said leg, said leg portion having an outer end which together with said first resilient support defines a universal joint, each of said first and second arms having an outer end which contacts the top of the valve stem of one of said first and second inlet valves;

a first roller which is rotatably supported by said rocker arm between said first and second arms and which is disposed between said resilient support and said inlet valves and which is arranged so as to engage with a cam which is disposed on a cam shaft of the engine;

first and second exhaust valves which control fluid communication between said combustion chamber and an exhaust manifold of the engine, each of said exhaust valves having a valve stem;

a second resilient support which is mounted on a portion of said means for defining a combustion chamber;

a second Y-shaped rocker arm having a leg and first and second arms which extend from said leg, said leg portion having an outer end which together with said second resilient support defines a universal joint, each of said first and second arms having an outer end which contacts the top of the valve stem of one of said first and second exhaust valves; and a second roller which is rotatably supported by said rocker arm between said first and second arms and which is disposed between said resilient support and said exhaust valves and which is arranged so as to engage with a cam which is disposed on a cam shaft of the engine.

18. An internal combustion engine as claimed in claim 17 further comprising first and second shafts which support said first and second rollers, respectively, each of the arms of said first and second rocker arms having a bore formed therein in which one of the ends of said first and second shafts is received.

19. An internal combustion engine as claimed in claim 17 wherein said first and second arms of said first and second rocker arms have first and second flanges, respectively, which are formed on said outer ends thereof, each of said flanges being able to engage with the top of the valve stem of the corresponding valve.

20. An internal combustion engine as claimed in claim 13 wherein said rocker arm further comprises a web which extends between said first and second arms and surrounds said roller, whereby the rigidity of said rocker arm is increased.

21. An internal combustion engine as claimed in claim 13 further comprising a shaft which supports said roller, said first and second arms of said rocker arm having slots formed therein into which the ends of said shaft fit.

22. An internal combustion engine as claimed in claim 17 wherein each of said first and second rocker arms further comprises a web which extends between the first and second arms of the rocker arm and surrounds the roller of the rocker arm, whereby the rigidity of the rocker arm is increased.

23. An internal combustion engine as claimed in claim 17 further comprising first and second shafts which support said first and second rollers, respectively, each of said arms of said rocker arms having a slot formed therein which receives one of the ends of the shaft of the corresponding roller, each of said slots having a curved portion and each of the ends of said shafts having a curved surface formed thereon which has substantially the same radius of curvature and which contacts the curved portion of the slot into which the end of the shaft fits.

* * * * *